United States Patent [19]

Koehler

[11] 4,080,677

[45] Mar. 28, 1978

[54] PORTABLE DIVER DISTRESS SIGNALLING DEVICE

[76] Inventor: Carlton L. Koehler, Box 236, Avalon, Calif. 90704

[21] Appl. No.: 767,697

[22] Filed: Feb. 11, 1977

[51] Int. Cl.[2] ..... B63C 9/21

[52] U.S. Cl. ..... 9/9; 9/14; 116/124 B; 206/.5

[58] Field of Search ..... 9/9, 14, 311, 313; 116/124 B, 124 R; 206/.5; 424/DIG. 9; 61/69 R, 69 A, 70

[56] References Cited

U.S. PATENT DOCUMENTS

| | | | |
|---|---|---|---|
| 2,418,392 | 4/1947 | Bender | 206/.5 |
| 2,750,027 | 6/1956 | Cummings | 206/.5 |
| 3,431,569 | 11/1969 | Gerke | 9/9 |

FOREIGN PATENT DOCUMENTS

| | | | |
|---|---|---|---|
| 4,876 of | 1898 | United Kingdom | 116/124 B |

*Primary Examiner*—Trygve M. Blix
*Assistant Examiner*—Stuart M. Goldstein
*Attorney, Agent, or Firm*—Fulwider, Patton, Rieber, Lee & Utecht

[57] ABSTRACT

A diver distress signalling device that has two separable dye containing elements. The device is strapped to a diver and includes an actuating mechanism. Upon actuation, the dye from one of the elements is released in the vicinity of the diver, while a float carries the other dye container to the water surface, streaming a trail of dye behind it. At the surface, dye is emitted to color the water in the vicinity of the float.

10 Claims, 3 Drawing Figures

Fig. 1
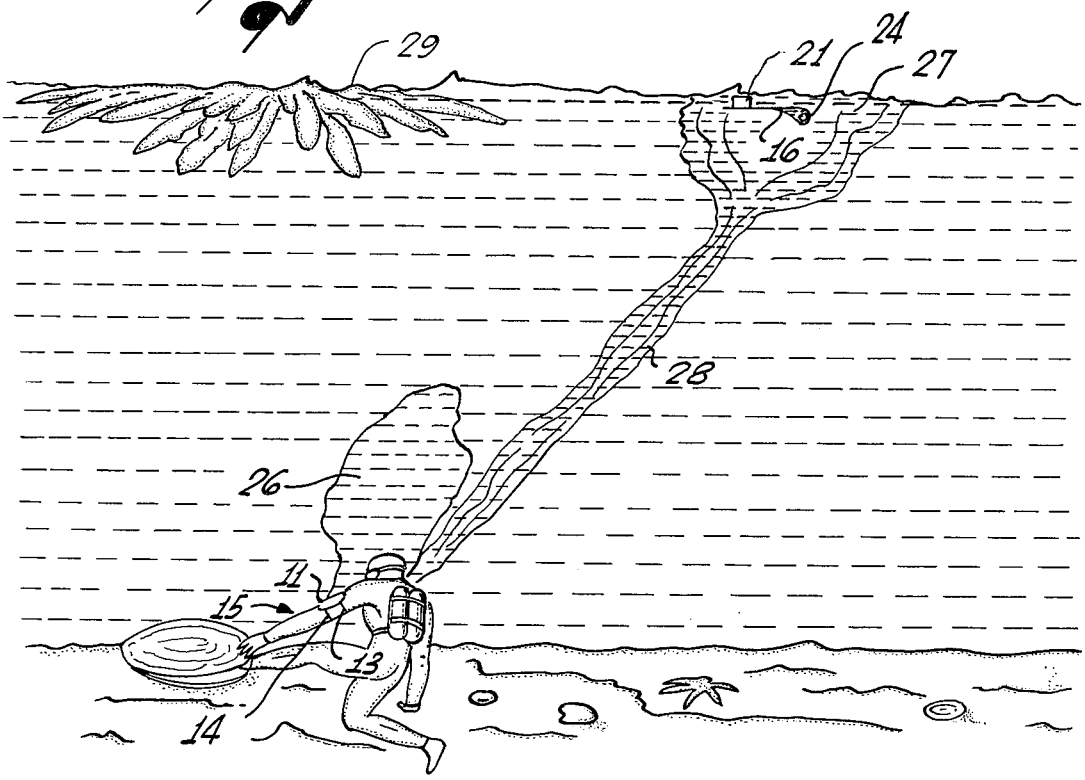
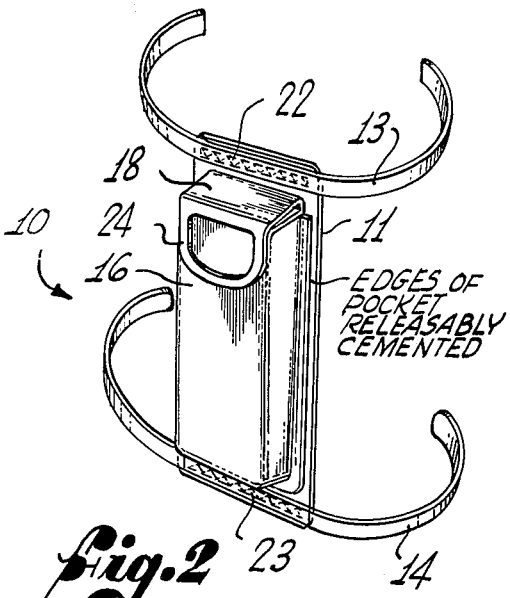
Fig. 2
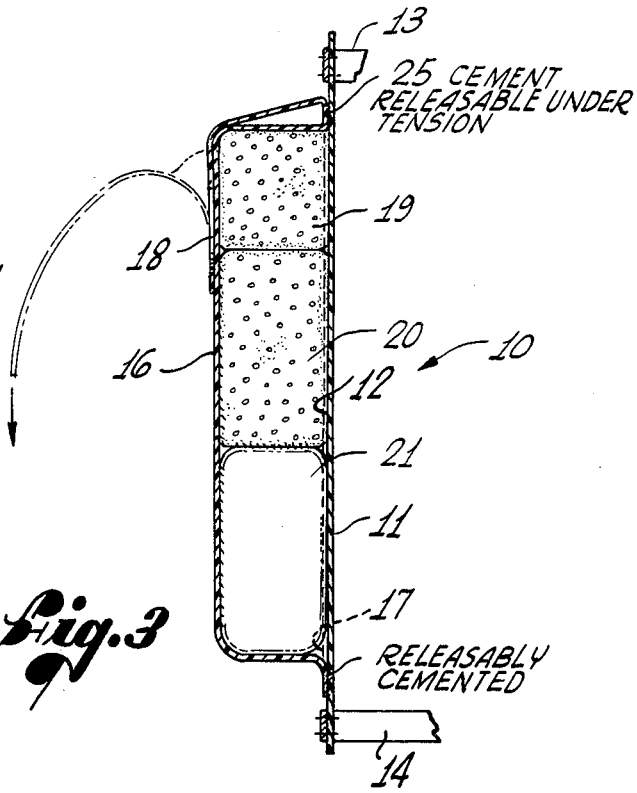
Fig. 3

PORTABLE DIVER DISTRESS SIGNALLING DEVICE

BACKGROUND OF THE INVENTION

1. Field of the Invention

The present invention relates to a portable diver distress signalling and locating device.

2. Description of the Prior Art

Portable dye type signals have been used in aviation and marine activity for a number of years. Extensive work was done in connection with such devices during World War II, to locate downed flyers on the surface of the water, and distress signalling devices that release a dye in the water to mark the location of a person or object on the water surface have been known since at least that time. While being acceptable for their intended use, conventional devices of this type suffer from several deficiencies when attempts have been made to adapt them to underwater signalling.

A principal shortcoming of the prior dye type distress signalling equipment is that suitable devices of this type have not been available to effectively provide an indication of diver location to potential rescuers arriving from beneath the surface of the water. Subsurface signalling is particularly important in non-military rescues. The conventional signalling devices do not deal with the emergency conditions and potential rescue situations that arise in diving sports, underwater scuba diving, fishing, subsurface exploration, and the like.

Conventional signalling devices do not locate the diver, but only disclose the surface area below which the diver is located. By using the device of the present invention, a diver in trouble beneath the water's surface and equipped with the distress signalling equipment of the present invention is able to signal for help to his diving companions, and to other divers in the area as well as to vessels or aircraft at or above the surface of the water, any of whom may either by operating in support of the diver in distress, or merely be passing by. Furthermore, with the device of the present invention, a trail is left from the initial point of distress should a diver extricate himself from a problem situation and attempt to reach safety, or otherwise travel or be carried from his initial position of distress.

In underwater diving the ability to communicate is generally limited to various hand signals. These signals are often unknown by novices or misunderstood by professionals. Even in commercial usage where there is frequent telephone communication to surface support vessels, there is seldom a dependable means of communciation between divers, who often operate within sight of each other.

The signal most needed by any diver is that of distress. It is important for distress signals to be communicated immediately, not only to those on the surface, but to other divers in the immediate vicinity of the diver in distress. In the past, many divers have lost their lives because of their inability to attract the attention of their assistant or "buddy" operating in the immediate area.

A further use and function of the invention is the utility of the device in changing underwater conditions or in areas of poor visibility. After a signal is given in a distress situation, location of the diver by rescuers is assured, even in turbid water or admidst heavy plant growth. The device of the present invention is able to achieve immediate signalling, both to underwater and surface observers, by virtue of its unique construction.

That is, the device is constructed with two separable portions, one of which remains attached to the diver and the other of which floats freely to the surface. It should be noted that the bouyant portion is not tethered to either the diver or the other portion of the signalling device. Such a connection could quite conceivably distrupt its operation, as the diver himself could become entangled in the tether line or the tether line might well become entrapped and ensnarled in kelp or other underwater plants. If this were to occur, the bouyant portion of the signalling device would not rise completely and would never reach the surface, hence its signalling capability would be severely limited.

Various other conventional dye markers have been used as signalling devices for military underwater divers. One of these, for example, is that described in U.S. Pat. No. 3,431,569. Such signalling devices are designed primarily to attract attention at the surface of the water. While these dye markers could be carried by divers, and activated beneath the surface, they necessarily incorporate a large amount of dye that would obscure underwater vision over a considerable area undersea. This would actually hamper assistance to a distressed diver by reducing visiblity in his vicinity. Moreover, the dye utilized in the particular patent to which reference is made utilizes a specific chemical dye which, upon contact with air, glows in the dark. This dye would not be easily visible underwater, however, which is a key feature of the signalling device of this invention.

The present invention can likewise incorporate a considerable quantity of dye in order to provide an adequate signal for help at the surface of the water. In constrast to conventional systems, however, this large quantity of dye is not released in the immediate area of the person to be rescued, but is instead carried to the surface of the water where its visiblity is greatest to both underwater and surface observers. Moreover, seawater is allowed to permeate the packet of dye as it is carried of dye indicating the location of the diver who released the packet. This system automatically compensates for current and drift.

A further feature of the present invention is that both portions of the signalling device can be activated by a single actuating motion. That is, a protective cover may be removed from a backing in a single swift action to release the portion of the device that floats to the surface, and also to activate the dye packet that remains with the diver. In contrast, conventional devices that incorporate a float as a signalling device are normally released entirely by the diver and thereafter float to the surface of the water. The decision as to whether or not to unfasten and release the dye packet requires a conscious election on the part of the diver, however, in evaluating his most likely source of help and electing to proceed to attract help from that source to the exclusion of other sources. That is, the diver with conventional devices must either choose to keep the dye packet fastened to his person, in the hope that a fellow diver will be drawn to his rescue, or he can release the float with the anticipation of help arriving from above. In either event, the conscious sacrifice of one means of signalling for help is required. Such an election requires manual dexterity, time, and considerable presence of mind in arriving at a proper solution, all of which are minimal in an underwater emergency.

The ability of the present device to effectively mark both the present position of a diver and his corresponding surface location is an important attribute. Moreover, the fact that the diver is able to achieve a maximum signalling capability both to other underwater divers and to surface observers without selecting one to the virtual exclusion of the other is of great comfort to the diver and operates to prevent a general panic situation from developing. Thus the invention provides a reliable, reassuring safety device.

A further feature of the invention is that the amount of dye in the packet that remains fastened to the diver is of a limited concentration and quantity, so that only a transparent cloud of water is colored by the dye in the vicinity of the diver. Thus, the cloud of dye beneath the surface is not so dense as to obscure the location of the diver. While the dye will typically create an opaque cloud immediately upon its release, spreading of the dye reduces the density of the cloud so that it becomes transparent. The net effect that one obtains by utilizing the device of the invention is a relatively dense cloud of dye at the surface of the water, thus providing a maximum visual signal, a trail of dye to the stricken diver, and a transparent cloud of dye in the vicintiy of the diver.

In one broad aspect the present invention is a portable underwater diver distress signalling device comprising: a water proof container which defines a water free cavity therein, and which may be actuated by separating the container into a backing portion that remains with the user and a protective portion designed for release and movement independent of the backing portion. A first water permeable dye packet is located within the cavity and secured to the backing portion releasing a quantity of dye in the vicinity of the diver upon separation of the protective cover from the backing portion. A second water permeable dye packet is located within the cavity for releasing a quantity of dye upon separating the protective cover portion from the backing portion. A float is attached to the protective cover portion for carrying that portion to the water surface upon separating the protective cover portion from the backing portion. In this way the second dye packet causes a marker dye concentration at the water surface when the container is actuated.

The present invention uniquely satisfies a growing safety need in a market where no comparable devices exist. Heretofore, no distress signal or location device has been available with the capabilities of the present invention. Inexpensive simplicity of the device assures timely mass production and wide distribution in this much needed safety field.

DESCRIPTION OF THE DRAWINGS

The present invention may be explained with greater clarity by reference to the accompanying drawings in which:

FIG. 1 depicts the device of the invention in use;

FIG. 2 is a perspective view of the portable underwater diver distress signalling device prior to use;

FIG. 3 is a side elevational sectional view of the portable underwater diver distress signalling device prior to use.

DETAILED DESCRIPTION OF THE INVENTION

Refering now to FIGS. 2 and 3 there is depicted the portable diver distress signalling device 10 which includes a backing 11 having a mounting surface 12 and formed from a sheet of water impermeable material. Straps 13 and 14 are fastened to the backing 11 and are used to secure the backing 11 to the diver 15 as depicted in FIG. 1. A water impermeable protective cover 16 is removably sealed to the backing 11 in a waterproof fashion to define a water free cavity 17 between the backing 11 and the protective cover 16 at the mounting surface 12. The protective cover 16 is provided with a release tab 18 which may be used to strip the protective cover 16 from the backing 11. A first water permeable packet 19 of marker dye is secured to the backing material 11 within the cavity 17. Likewise a second water permeable packet 20 of market dye can be secured to the protective cover 16. A float 21 may be attached to the protective cover 16 for carrying the cover 16 and the second packet 20 of dye to the water surface independent of the backing 11 when the protective cover 16 is stripped from the backing material 11 beneath the surface of the water. Alternatively, the float 21 an packet 20 need not be attached to the cover 16, but could be designed to float to the surface free from the cover 16. The float 21 can be carried free within the cavity 17 so that it will rise to the surface when the cover 16 is separated from backing 11.

The straps 13 and 14 are flexible tapes or cords, capable of attachment either to the equipment of the diver, or directly to the body of the diver in an easily accessible location. The straps 13 and 14 are two distinct straps secured respectively by stitching at 22 and 23 to the backing material 11 so that they are immobilized relative to the backing material 11 at spacially separated locations on the backing. Each of the straps laterally extends 6 or 8 inches from the edge of either side of the backing material 11 so that the straps 13 and 14 may be tied to an air tank or to the leg or shoulder of the diver 15.

The backing 11 is constructed of waterproof cloth or plastic, as is the cover 16. The edges of the cover 16 and backing 11 are releasably cemented to each other with a waterproof adhesive or they may be heat sealed together. Thus, while the cover 16 and backing 11 are attached to each other, their mutual configuration is such as to form a waterproof cavity 17. When the aperture in the release flap 18 is grasped and pulled downward as indicated in FIG. 3, however, the upper area of adhesive at 25 proximate to the strap 13 is broken, and the cover 16 then readily parts from the backing material 11 and is easily separated from it. Some conventional devices employ ties or straps to hold the parts of a signalling device together. These are generally tied in a square knot which may be quite difficult to release in stressful emergency situations, especially where the divers fingers are numb with cold or fear.

The function of the spacial displacement of the straps 13 and 14 should be noted in connection with the separation of the cover 16 from the backing 11. Because of the separation in distance of the straps 13 and 14, a good leverage is provided for stripping the cover 16 from the backing 11. The rim 24 of the aperture of the release flap 18 is reinforced with a plastic ring in the shape of a D to facilitate grasping. Thus, even though the hands of the diver might be quite cold and numb, the distress device configuration is such that he is easily able to catch the ring at 24, break the bond of waterproof cement adjacent to strap 13 at the point indicated at 25, and strip the cover 16 from the backing 11. The cover 16 is preferably designed to be completely removed from the backing 11 so that the diver can bring the cover 16 into his view to be assured that the signalling device has been activated. The device would function adequately, however, even if separation is only partial as long as the waterproof seal is broken to allow water to permeate the dye packets and to allow the float to escape.

Within the water tight enclosure 17, a smaller dye packet 19 is fastened to the backing material 11 within a water permeable pouch or sack. Thus, once the cover 16 is removed seawater is allowed to penetrate the dye packet 19 and create a cloud of dye in the vicinity of the diver 15, as indicated at 26 in FIG. 1. By releasing a measured amount of dye at the diver's location, a distinct colored cloud 26 evolves, but the cloud remains sufficiently transparent so that underwater visibility is not lost. An assistant diver or "buddy" within the range of visibility would easily recognize the cloud 26 spreading near the distressed diver, as well as the distinctive column 28 of dye trailing to the surface from the other packet 20.

The second and larger packet 20 of dye is attached to the bouyant float 21 and is released to rise to the surface trailing a bright column 28 of dye behind it. On the surface, the dye packet 20 bouyed up by the float 21, spreads its distinctive mark at 27, indicating the call for assistance by the diver 15, and his general location beneath the surface of the water. The surface mark 27 is sufficiently dense in color and spreads to a sufficient degree to be immediately visible to any casual observer or searcher. The float 21 might or might not be equipped with a small flag or streamer to aid in attracting attention. The cover 16 can be marked with instructions as to the purpose of the marker so that the crew of any pleasure craft or other vessel in the vicinity, who might be unfamiliar with the device, will be able to act intelligently to aid in rescuing the diver in distress.

The second dye packet 20 is of sufficient water sensitivity to create a trail 28 of dye from this diver 15 to the water surface as the float 21 carries the protective cover portion 16 of the device 10 to the water surface. Thus, rescue personnel at or above the surface of the endangered diver can follow the column 28 of dye left by the rising dye packet 20. This procedure can even be done in conditions of turbid water.

The dye used in both of the packets 19 and 20 is preferably a fluroscent, powder dye which is water soluble and highly visible. The packet structure allows the dye to escape at a rate controlled with respect to time. The dye color may vary, but a color of high contrast with water should be used, such as yellow-green of fluorescein, which is recognized as a distress signal.

A further feature of one embodiment of the invention involves the addition of a quantity of shark repellent with the dye in the first dye packet 19, which is the packet that remains in the proximity of the diver 15. The shark repellent would be located in the water tight cavity 17 until use, so that it would not be prematurely dissipated. Since a diver in distress becomes quite vulnerable to marauding sharks, this feature is of particular value in compensating for the diver's tenuous position when he is already in distress.

To use the distress signalling device of the invention, the device 10 may be initially fastened to the arm of a diver 15, as indicated in FIG. 1. This illustration shows the backing material 11 strapped around the left arm of the diver by straps 13 and 14. When in distress, the diver 15 merely seizes the reinforced ring 24 surrounding the aperture of the flexible release tab 18. By pulling downward on the flap 18 as indicated in FIG. 3, the waterproof seal at 25 is broken and the cover 16 is stripped from the backing 11, with the seal being broken throughout the length of the device 10 until the cover 16 and backing 11 are in separate pieces or portions of what was previously a single waterproof container. The diver 15 then releases the flap 18 from his grasp, so that the float 21, which was located within the cavity 17 and which is attached by waterproof cement or other means of fastening to the cover 16, is lifted towards the surface of the water. As the float 21 rises, it carries with it the cover 16, to which is also attached the second or larger dye packet 20. As the cover 16 rises, a trail of dye 28 is left. Once the float 21 surfaces, the seawater continues to permeate the dye packet 20 creating a cloud 27 of dye at the water surface. Concurrently, the seawater creates a transparent cloud 26 beneath the water surface by penetrating the smaller dye packet 19 so that the diver 15 signals his distress to fellow divers in the area.

Because there is no physical attachment of the cover 16 to the backing 11 when the two portions of the container are separated, the float 21 will not become entrapped in or restrained from its upward movement by bodies of kelp 29, or by other underwater obstructions.

The foregoing features and preferred construction of the invention depicted should not be construed as limiting. While as but a single possible embodiment has been illustrated, the invention is nevertheless defined in its broader sense by the scope of the claims appended hereto.

I claim:

1. A portable diving distress signalling device comprising:

a backing having a mounting surface and formed of a sheet of water impermeable material;

strapping fastened to said backing for securing said backing to a diver;

a water impermeable protective cover removably sealed to said backing in a waterproof fashion to define a water free cavity between said backing and said protective cover at said mounting surface of said backing and providing a release tab which may be used to strip said protective cover from said backing;

a first water permeable packet of marker dye secured to said backing material within said cavity.

a second water permeable packet of marker dye located within said cavity and disassociated from said backing; and a float attached to said second packet of dye for carrying it to the surface of a body of water independent of said backing when said protective cover is stripped from said backing material beneath the surface of the water.

2. The device of claim 1 further characterized in that said first packet of marker dye is smaller than said second packet of marker dye.

3. The device of claim 1 further characterized in that said float is located within said cavity.

4. The device of claim 1 further characterized in that said strapping comprises separate and distinct straps secured to said backing and immobilized relative thereto at spatially separated locations on said backing.

5. The device of claim 1 further characterized in that the dye within each of said packets of marker dye is a powder, water soluble, fluorescent dye.

6. The device of claim 1 further characterized in that said release tab is comprised of a flap of flexible material with a reinforced aperture therein secured to said protective backing proximate to at least a portion of said strapping.

7. the device of claim 1 further characterized in that said second packet of dye is secured to said cover and said float is also secured to said cover.

8. A portable underwater diver distress signalling device comprising: a waterproof container which defines a water free cavity therein, and which may be actuated by separating said container into a backing portion that remains with the user and a protective cover portion designed for release and movement independent of said backing portion; a first water permeable dye packet located within said cavity and secured to said backing portion for releasing a quantity of dye in the vicinty of said diver upon separation of said protective cover portion from said backing portion; a second water permeable dye packet located within said cavity disassociated from said backing portion for releasing a quantity of dye upon separating said protective cover portion from said backing portion; and a float attached to said second packet of dye for carrying said second packet of dye to the water surface upon separating said protective cover portion from said backing portion, whereby said second dye packet causes a marker dye concentration at the water surface when said container is actuated.

9. The device according to claim 7 further characterized in that said first dye packet contains dye in a limited concentration to create only a transparent cloud of water colored by said dye in the vicinity of said diver.

10. The device according to claim 7 further characterized in that said second dye packet is sufficiently water sensitive to create a trail of dye from said diver to the water surface as said float causes said second dye packet to rise to the surface of the water.

* * * * *